US007591298B2

(12) United States Patent
Egami et al.

(10) Patent No.: US 7,591,298 B2
(45) Date of Patent: Sep. 22, 2009

(54) ON-FAILURE BLIND STOPPER SYSTEM

(75) Inventors: Ken-ichiro Egami, Tokyo (JP); Koji Takagi, Tokyo (JP)

(73) Assignee: Nichibei Co., Ltd., Tokyo (JP)

( * ) Notice: Subject to any disclaimer, the term of this patent is extended or adjusted under 35 U.S.C. 154(b) by 219 days.

(21) Appl. No.: 11/554,176

(22) Filed: Oct. 30, 2006

(65) Prior Publication Data

US 2007/0102124 A1 May 10, 2007

(30) Foreign Application Priority Data

Nov. 8, 2005 (JP) ..... 2005-324119

(51) Int. Cl.
*E06B 9/36* (2006.01)

(52) U.S. Cl. ..... 160/168.1 R; 160/170; 160/178.2; 160/84.04

(58) Field of Classification Search ..... 160/168.1 R, 160/170, 173 R, 178.1 R, 178.2, 84.04, 84.05
See application file for complete search history.

(56) References Cited

U.S. PATENT DOCUMENTS

| | | | | |
|---|---|---|---|---|
| 4,704,914 | A * | 11/1987 | Horng | 74/411.5 |
| 5,103,888 | A * | 4/1992 | Nakamura | 160/171 |
| 5,706,552 | A * | 1/1998 | Hsieh | 16/82 |
| 6,042,158 | A * | 3/2000 | Horn | 292/165 |
| 6,230,784 | B1 * | 5/2001 | Sanz et al. | 160/84.02 |
| 6,530,414 | B2 * | 3/2003 | Mayr et al. | 160/98 |
| 7,000,354 | B2 * | 2/2006 | Beaudoin et al. | 49/322 |
| 2002/0069585 | A1 * | 6/2002 | Schiks | 49/200 |

* cited by examiner

*Primary Examiner*—Katherine W Mitchell
*Assistant Examiner*—Jaime F Cardenas-Garcia
(74) *Attorney, Agent, or Firm*—Miller, Matthias & Hull

(57) ABSTRACT

To provide an on-failure blind stopper system that allows reduction of depth of a head box and can be surely activated. A slider capable of moving vertically is disposed in a head box. The slider is pressed by a lifting/lowering cord and prevented from moving upward to permit a rotation shaft to rotate when the lifting/lowering cord is under tension. On the other hand, the slider moves upward to engage with the rotation shaft to prevent the rotation of the rotation shaft when the lifting/lowering cord sags.

5 Claims, 4 Drawing Sheets

ON-FAILURE BLIND STOPPER SYSTEM

BACKGROUND OF THE INVENTION

1. Field of the Invention

The present invention relates to an on-failure blind stopper system that stops rotation of a rotation shaft when a failure occurs during lifting or lowering of a bottom part of a blind whose shielding member(s) is lifted or lowered by that a lifting/lowering cord lifts or lowers the bottom part.

2. Description of the Related Art

A known conventional on-failure blind stopper system of this kind is described in Japanese Utility Model Publication No. H3-51516. In this publication, a roller for guiding a lifting/lowering cord is disposed at an opening in a side plate of a support main unit for supporting a take-up drum, and a claw is disposed in the support main unit. The claw has a contact member adapted to abut against the lifting/lowering cord on one side thereof, and is pivoted at one end thereof, and is urged upward at the other end thereof by a spring so that the claw can abut against a ratchet wheel. If a shielding member of the blind bumps against an obstacle, the lifting/lowering cord sags, and the pressing force from the lifting/lowering cord on the contact member is removed. Thus, the claw rotates about the pivot point to engage with the ratchet wheel, thereby stopping the rotation of the take-up drum and stopping the movement of the lifting/lowering cord.

SUMMARY OF THE INVENTION

However, in the type where the claw rotates as described in Japanese Utility Model Publication No. H3-51516, a problem is that the ratchet wheel and the claw cannot be sufficiently spaced apart from each other, and the stroke of the rotation of the claw is short, so that malfunctions are likely to occur.

In order to sufficiently separate the ratchet wheel and the claw from each other to provide a long stroke, the depth of the head box has to be increased. Thus, the head box disadvantageously becomes large. In particular, when incorporating the blind in a double glazing, the blind having the head box of the increased depth, cannot problematically be assembled into the double glazing because the spacing between the sheets of glass of the double glazing is typically limited to a small dimension, such as within a range of 12 mm to 20 mm.

The present invention has been devised in view of such problems, and an object of the present invention is to provide an on-failure blind stopper system that allows reduction of depth of a head box and can be surely activated.

In order to attain the object described above, an on-failure blind stopper system according to the present invention for a blind in which a lifting/lowering cord that vertically moves in response to rotation of a rotation shaft in a head box has a lower end hanging from the head box and connected to a bottom part disposed at the bottom of shielding members, and the shielding member (s) is lifted or lowered by lifting or lowering the bottom part by the lifting/lowering cord, comprises a on-failure stopper assembly that stops rotation of the rotation shaft when a failure occurs in lifting or lowering of the bottom part. The on-failure stopper assembly has a restriction member that is vertically movable in the head box. The restriction member is pressed by the lifting/lowering cord and prevented from moving upward or downward to permit the rotation shaft to rotate when the lifting/lowering cord is under tension and moves upward or downward to engage with the rotation shaft to prevent the rotation of the rotation shaft when the lifting/lowering cord sags.

Since the restriction member moves in the vertical direction to engage with the rotation shaft to stop the rotation thereof, the stroke can be long, and malfunctions thereof can be prevented. The on-failure stopping operation does not affect the depth of the head box, so that the depth of the head box can be reduced.

The on-failure stopper assembly can comprise a ratchet that rotates together with the rotation shaft, the restriction member having an engaging part that is movable in a vertical direction and capable of engaging with the ratchet, an elastic member that urges the restriction member upward or downward, and a guide part that is movable in a vertical direction together with the restriction member and with which the lifting/lowering cord is in contact in a slidable manner.

The engaging part and the guide part may be respectively located on the vertically opposite sides of the rotation shaft. Since the engaging part that engages with the ratchet rotating together with the rotation shaft and the guide part are located on the vertically opposite sides of the rotation shaft, the space in the head box can be used efficiently in the height direction.

A take-up drum capable of rotating together with the rotation shaft can be provided on the rotation shaft, and the lifting/lowering cord capable of being wound around and unwound from the take-up drum can extend from the take-up drum, subsequently, be guided upward in the head box, be directed in the longitudinal direction of the head box, pass over the guide part of the on-failure stopper assembly, be directed to below the head box and extend to the bottom part. Since the lifting/lowering cord passes over the guide part, unlike the prior art, the lifting/lowering cord does not have to pass through a narrow space, and arrangement of the lifting/lowering cord is facilitated.

The blind can be incorporated in a double glazing, and a failure may occur in lifting or lowering of the bottom part because of a deformation of the glass of the double glazing. Even in the case where a failure occurs in lifting or lowering of the bottom part because of deformation of the glass of the double glazing incorporating the blind, the movement of the bottom part can be stopped without fail, so that malfunctions or damage to the product can be prevented.

The present disclosure relates to subject manner contained in Japanese Patent Application No. 2005-324119, filed on Nov. 8, 2005, which is expressly incorporated herein by reference in its entirety.

DETAILED DESCRIPTION OF THE PREFERRED EMBODIMENTS

In the following, an embodiment of the present invention will be described with reference to the drawings.

Figure 1:
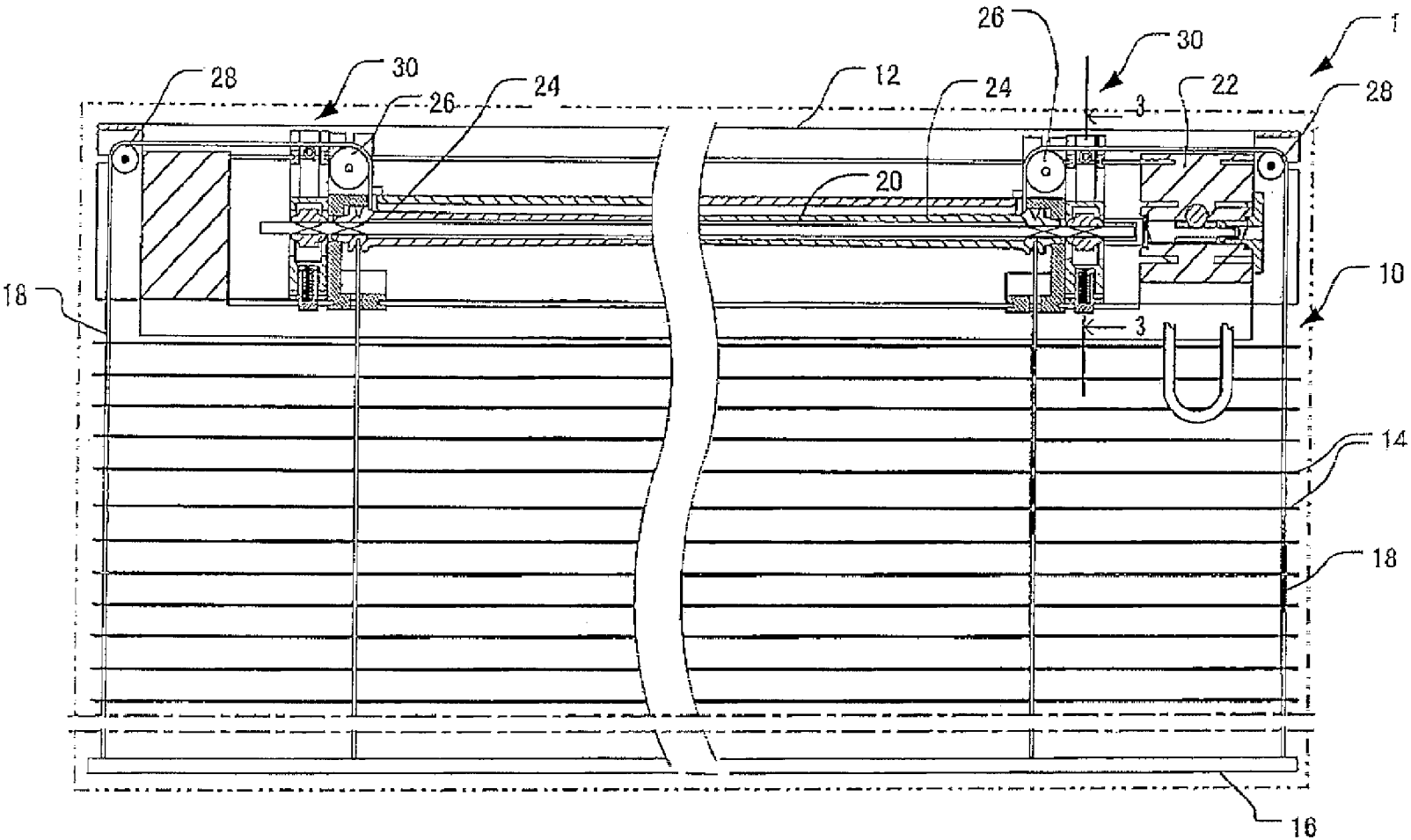
FIG. 1 is a front view of a blind to which an on-failure blind stopper system according to the embodiment of the present invention is applied.
Figure 2:
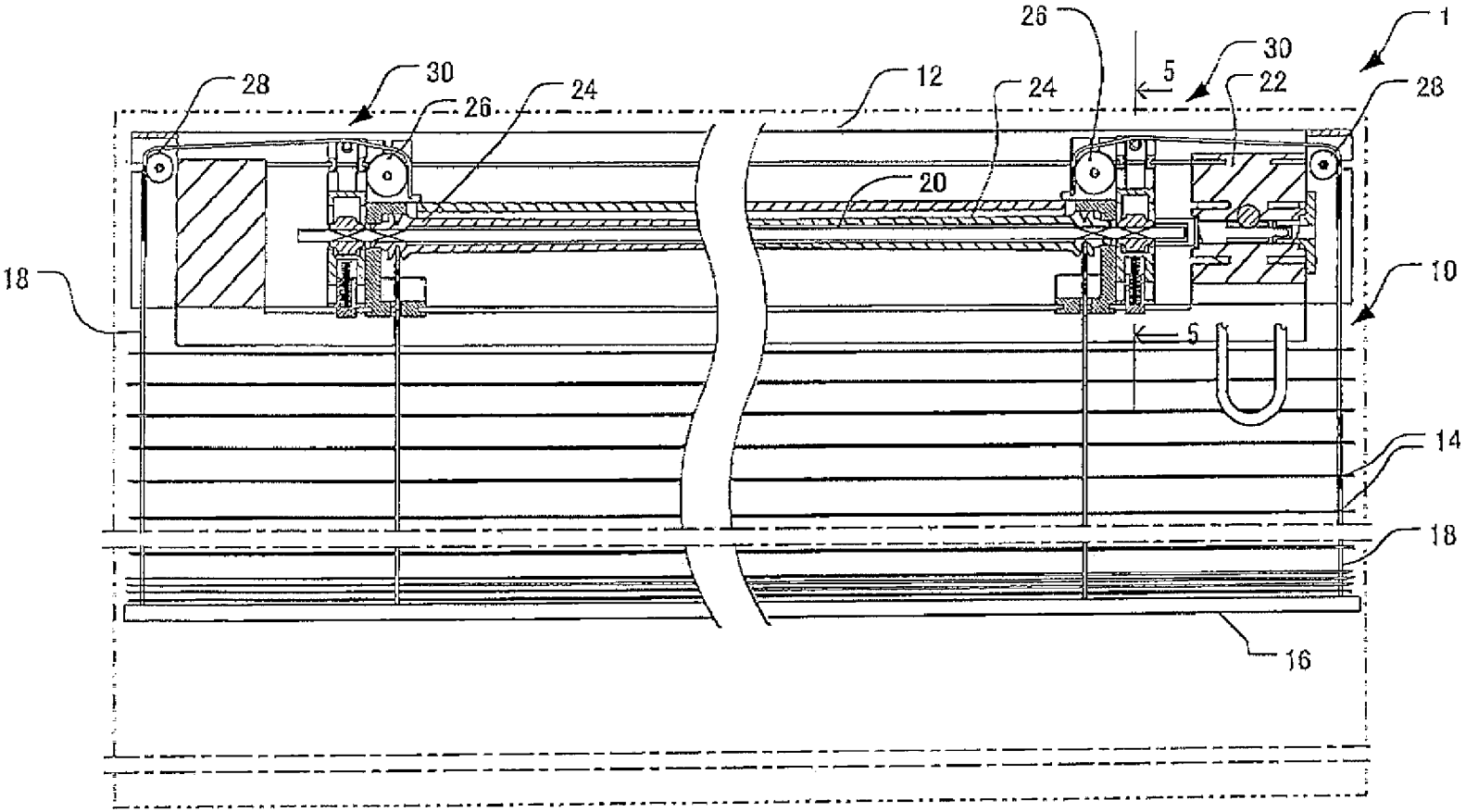
FIG. 2 is a front view of the blind in the case where an on-failure blind stopper system is activated.

FIG. 1 is a front view of a blind to which a non-failure blind stopper system according to the embodiment of the present invention is applied.

Figure 3:
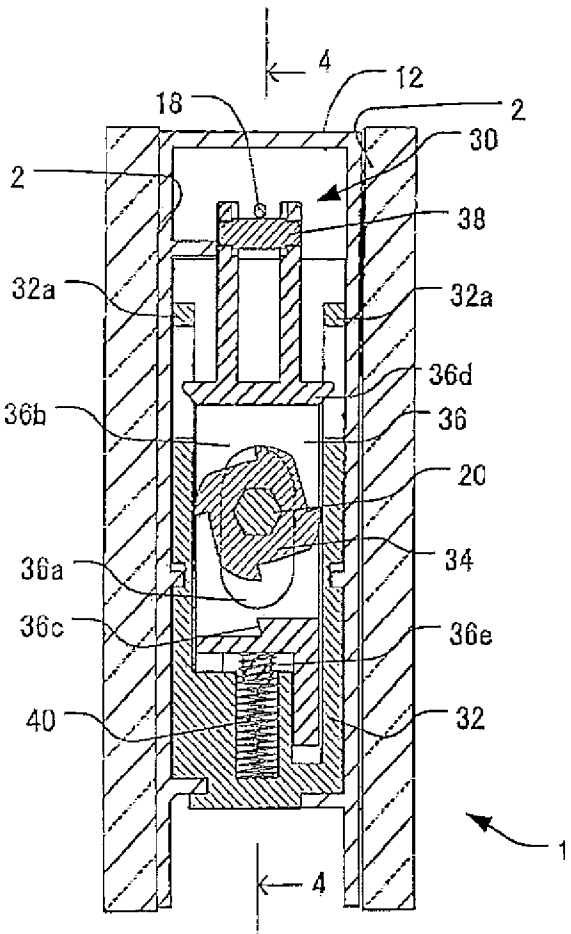
FIG. 3 is a cross-sectional view taken along the line 3-3 in FIG. 1.

A blind 10 shown in this drawing is a double glazing-incorporated type and incorporated in a double glazing 1. The blind 10 is disposed in a space between the surfaces of two sheets 2, 2 of glass of the double glazing 1 as shown in FIG. 3. The on-failure blind stopper system according to the present invention is suitable for such a blind disposed in a narrow space in the double glazing 1. However, the application of the on-failure blind stopper system is not limited thereto, and the on-failure blind stopper system can be applied to a blind that is not incorporated in the double glazing 1.

The blind 10 has a head box 12. Shielding members 14 hang down from the head box 12, and a bottom part 16 is provided on the lowermost end of the shielding members 14. Lifting/lowering cords 18 hang down from the head box 12 and are connected to the bottom part 16 at the lower end thereof.

In the head box 12, a rotation shaft 20 that extends in the longitudinal direction is rotatably supported, and one end of the rotation shaft 20 is coupled to a manipulation unit 22. Manipulating the manipulation unit 22 causes the rotation shaft 20 to rotate in either direction In addition, a plurality of take-up drums 24 adapted to rotate together with the rotation shaft 20 are attached to the periphery of the rotation shaft 20, and the upper end of each lifting/lowering cord 18 is connected to its corresponding one of the take-up drums 24. The lifting/lowering cord 18 can be wound around and unwound from the take-up drum 24, and winding or unwinding the lifting/lowering cord 18 makes the lower end thereof move upward or downward.

The lifting/lowering cord 18 extends from the take-up drum 24, is guided upward in the head box 12, is directed in the longitudinal direction of the head box 12 by a pulley 26, passes over on-failure stopper assembly 30 described later and then is redirected to below the head box 12 by a second pulley 28 disposed at the end of the head box 12 so that the lower end of the lifting/lowering cord 18 is directed to the bottom part 16.

Figure 4:
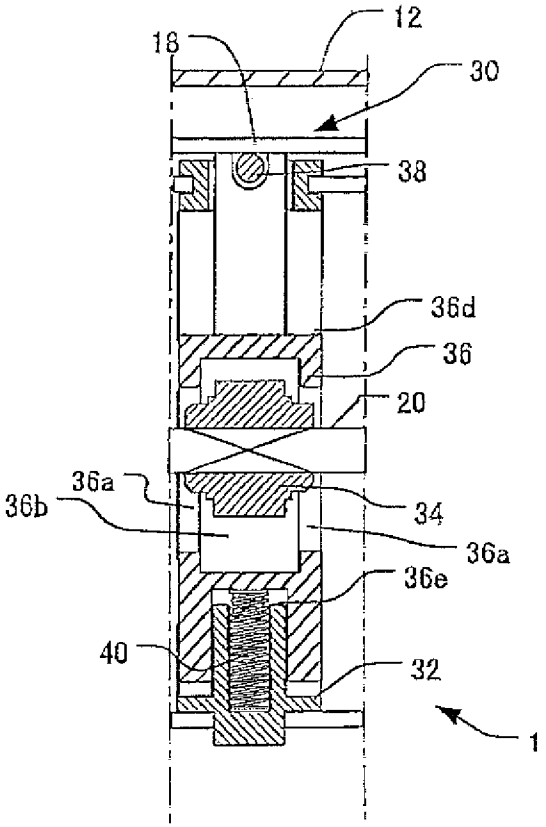
FIG. 4 is a cross-sectional view taken along the line 4-4 in FIG. 3.

The on-failure stopper assembly 30 disposed in the head box 12 is preferably provided for each lifting/lowering cord 18. Specifically, as shown in FIGS. 3 and 4, the on-failure stopper assembly 30 comprises a case 32 fixed in the head box 12 through which the rotation shaft 20 passes, a ratchet 34 that is mounted on the rotation shaft 20 in the case 32 so as to rotate together with the rotation shaft 20, a slider 36 (restriction member) capable of sliding vertically relative to the case 32, a compression spring 40 (an elastic member) that urges the slider 36 upward, and a guide roller 38 (a guide part) that is supported on the upper end of the slider 36 and is capable of vertically moving together with the slider 36.

The slider 36 has vertically elongated openings 36*a*, 36*a* formed in opposite side walls thereof, and the rotation shaft 20 passes through the elongated openings 36*a*, 36*a*. An empty space 36*b* is formed between the opposite wide walls, in which the ratchet 34 is disposed. In a lower part of the empty space 36*b*, an engaging part 36*c* capable of engaging with the teeth of the ratchet of the ratchet 34 is disposed. In addition, the slider 36 has an engaging bar 36*d* disposed in the upper portion of the empty space 36*b*. A stopper 32*a* formed in the case 32 interferes with the engaging bar 36*d* and restricts the vertical movement of the slider 36.

The slider 36 has a spring receiving recess 36*e* in the lower part thereof. The compression spring 40 is inserted between the top of the spring receiving recess 36*e* and the bottom of the case 32 and constantly urges upward the slider 36.

The guide roller 38 is rotatably supported at the upper end of the slider 36. The lifting/lowering cord 18 is in contact with the top of the guide roller 38 in a slidable manner, and the guide roller 38 is pressed downward by the tension of the lifting/lowering cord 18. Alternatively, the guide roller 38 and the slider 36 may be integrally formed as one piece.

Thus, the guide roller 38 of the on-failure stopper assembly 30 and the engaging part 36*c* of the slider 36 are respectively positioned on the vertically opposite sides of the rotation shaft 20.

In the blind arranged as described above, when the rotation shaft 20 and the take-up drums 24 rotate in response to manipulations of the manipulation unit 22, the lifting/lowering cords 18 are wound around or unwound from the take-up drums 24 depending on the direction of the rotation. The lower end of the lifting/lowering cord 18 is lifted or lowered with the lifting/lowering cord 18 stretched by the weight of the bottom part 16, and accordingly the bottom part 16 and the shielding members 14 are lifted or lowered.

During such a normal operation, in the on-failure stopper assembly 30 of the on-failure blind stopper system according to the present invention, the slider 36 is pressed downward against the force of the spring 40 by the tension of the lifting/lowering cord 18, as shown in FIGS. 3 and 4. Therefore, the engaging part 36*c* and the ratchet 34 are separated apart from each other, so that the movement of the lifting/lowering cord 18 is not hindered.

On the other hand, for example, downward movement of the bottom part 16 may be hindered because the spacing between the sheets of glass 2, 2 of the double glazing 1 decreases. Otherwise, even in a case of the blinds other than those disposed in the double glazing 1, the bottom part 16 may bump against an obstacle during downward movement and thus be hindered from moving. In such cases, if the lowering operation continued, the lifting/lowering cord 18 would sag, and when the lifting/lowering cord 18 becomes able to move again, the sag lifting/lowering cord 18 would be reversely wound around the take-up drum 24, thereby causing malfunctions or damage to the product. Thus, the movement of the lifting/lowering cord 18 has to be stopped.

Figure 6:
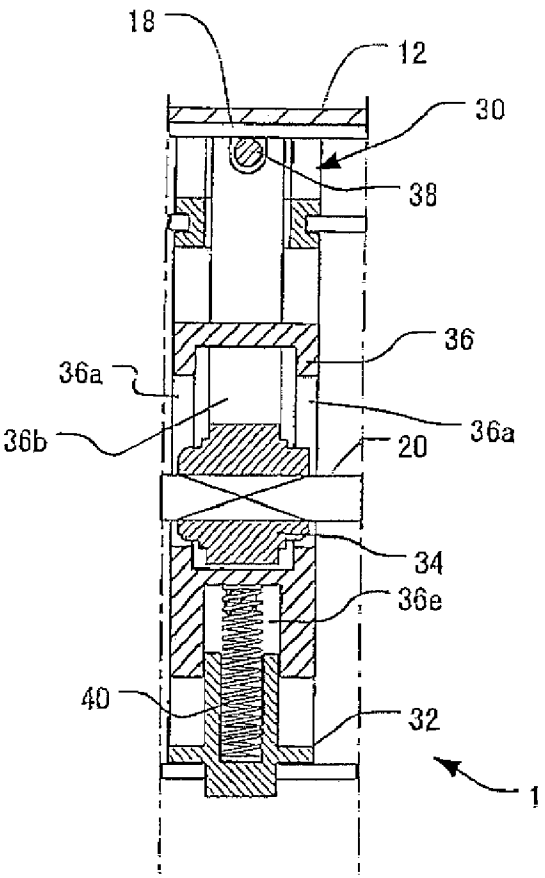
FIG. 6 is a cross-sectional view taken along the line 6-6 in FIG. 5.
Figure 5:
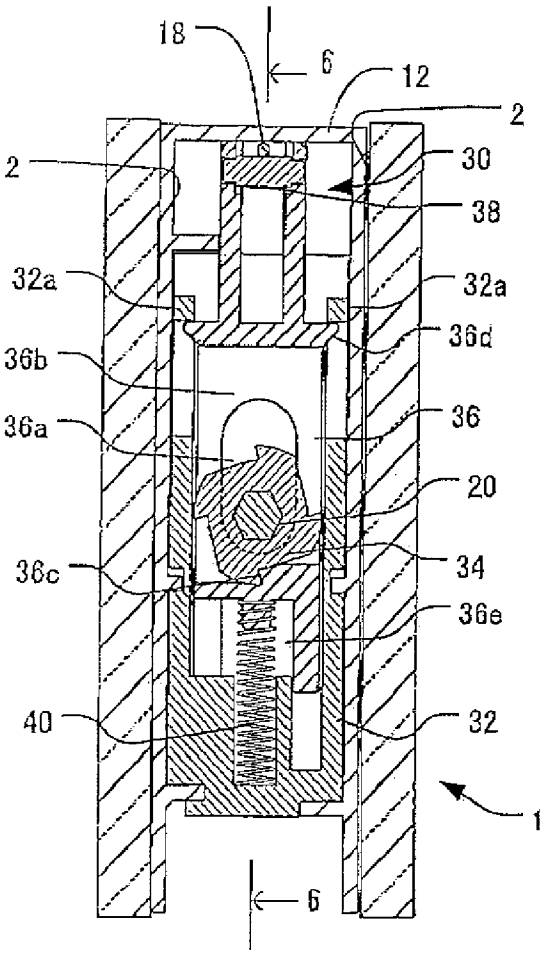
FIG. 5 is a cross-sectional view taken along the line 5-5 in FIG. 2.

In the on-failure blind stopper system according to the present invention, when the failure described above occurs, the weight of the bottom part 16 and thus the tension are removed from the lifting/lowering cord 18. Thus, the slider 36 moves upward by the operation of the spring 40, and the engaging part 36*c* engages with the ratchet 34 as shown in FIGS. 5 and 6. Then, the rotation shaft 20 becomes unable to rotate in the direction corresponding to the direction of the lowering of the lifting/lowering cord 18, and the lowering of the lifting/lowering cord 18 stops. In this way, the movement of the lifting/lowering cord 18 can be hindered, thereby preventing malfunctions and damage to the product.

In the on-failure stopper assembly 30 according to the present invention, since the slider 36 moves in the vertical direction, the stroke can be long, and malfunctions thereof can be prevented. In particular, since the engaging part 36*c* of the slider 36 and the guide roller 38 are respectively disposed on the opposite sides of the rotation shaft 20, the space in the head box 12 can be used efficiently in the height direction, and as a result, the depth of the head box 12 can be reduced.

In the example described above, the slider 36 is normally located at the lower position and moves upward when the on-failure blind stopper system is activated. However, the present invention is not limited thereto, and the slider 36 may be normally located at the higher position and move downward by the action of a spring or gravity when the on-failure blind stopper system is activated, as in the case where the lifting/lowering cord 18 is in contact with the bottom of the guide roller 38 in a slidable manner.

However, passing the lifting/lowering cord 18 over the guide roller 38 as shown eliminates the need for passing the lifting/lowering cord 18 through a narrow space, so that arrangement of the lifting/lowering cord 18 is facilitated.

While the principles of the invention have been described above in connection with specific embodiments, and particular modifications thereof, it is to be clearly understood that this description is made only by way of example and not as a limitation on the scope of invention.

What is claimed is:

1. An on-failure blind stopper system for a blind in which a lifting/lowering cord that vertically moves in response to rotation of a rotation shaft in a head box has a lower end hanging from the head box and connected to a bottom part disposed at the bottom of shielding member(s), and the shielding member is lifted or lowered by lifting or lowering the bottom part by the lifting/lowering cord, the on-failure blind stopper system comprising on-failure stopper assembly that stops rotation of the rotation shaft when a failure occurs in lifting or lowering of the bottom part, wherein said on-failure stopper assembly comprises a restriction member that is vertically movable in the head box, and the restriction member through which the rotation shaft passes is pressed by the lifting/lowering cord and prevented from moving upward or downward to permit the rotation shaft to rotate when the lifting/lowering cord is under tension and moves upward or downward to engage with the rotation shaft to prevent the rotation of the rotation shaft when the lifting/lowering cord sags.

2. The on-failure blind stopper system according to claim 1, wherein said on-failure stopper assembly comprises a ratchet that rotates together with the rotation shaft, said restriction member having an engaging part that is movable in a vertical direction and capable of engaging with the ratchet, an elastic member that urges upward or downward the restriction member, and a guide part that is movable in a vertical direction together with the restriction member and with which the lifting/lowering cord is in contact in a slidable manner.

3. The on-failure blind stopper system according to claim 2, wherein said engaging part and the guide part are located on the vertically opposite sides of the rotation shaft.

4. The on-failure blind stopper system according to claim 2, wherein a take-up drum capable of rotating together with the rotation shaft is provided on the rotation shaft, and the lifting/lowering cord capable of being wound around and unwound from the take-up drum extends from the take-up drum, subsequently, is guided upward in the head box, is subsequently directed in the longitudinal direction of the head box, passes over the guide part of the on-failure stopper assembly, is directed to below the head box and extends to the bottom part.

5. The on-failure blind stopper system according to claim 1, wherein said blind is incorporated in a double glazing.

* * * * *